US007891506B2

(12) United States Patent
Kornowski

(10) Patent No.: US 7,891,506 B2
(45) Date of Patent: Feb. 22, 2011

(54) JEWELRY HOLDER AND DISPLAY

(76) Inventor: Georgica Kornowski, 627 Sandpebble Dr., Schaumburg, IL (US) 60193

( * ) Notice: Subject to any disclaimer, the term of this patent is extended or adjusted under 35 U.S.C. 154(b) by 280 days.

(21) Appl. No.: 11/868,770

(22) Filed: Oct. 8, 2007

(65) Prior Publication Data

US 2009/0065373 A1 Mar. 12, 2009

Related U.S. Application Data

(63) Continuation-in-part of application No. 29/284,399, filed on Sep. 7, 2007, now Pat. No. Des. 574,165.

(51) Int. Cl.
*A47F 7/02* (2006.01)

(52) U.S. Cl. ..... 211/85.2; 211/205; 211/163

(58) Field of Classification Search ..... 211/163, 211/85.2, 85.3, 70, 33, 30, 1.55, 1.54, 1.53, 211/1.3, 95, 115, 196, 197, 205, 107, 58; 312/249.2, 135; 206/6.1; *A47B 49/40*
See application file for complete search history.

(56) References Cited

U.S. PATENT DOCUMENTS

| | | | | | |
|---|---|---|---|---|---|
| 71,976 | A | * | 12/1867 | Carrier | 211/1 |
| 785,196 | A | * | 3/1905 | Cannon | 211/190 |
| 830,577 | A | * | 9/1906 | Devine | |
| 3,997,050 | A | * | 12/1976 | Patterson | 206/566 |
| 4,121,720 | A | | 10/1978 | Hayes | |
| 4,141,453 | A | * | 2/1979 | Hanan | 211/163 |
| 4,390,099 | A | | 6/1983 | Trautlein et al. | |
| 4,442,942 | A | * | 4/1984 | Cuminale et al. | 211/163 |
| 4,534,471 | A | * | 8/1985 | Zahn et al. | 211/39 |
| 4,635,894 | A | * | 1/1987 | Sammons | 248/558 |
| 4,850,658 | A | | 7/1989 | Sandor | |
| 5,052,563 | A | * | 10/1991 | Camp | 211/85.2 |
| 5,054,624 | A | | 10/1991 | Camp | |
| 5,176,263 | A | | 1/1993 | Caruso | |
| 5,257,703 | A | * | 11/1993 | Ascik et al. | 211/166 |
| 5,449,073 | A | | 9/1995 | DeBeverly | |
| 5,487,600 | A | * | 1/1996 | Griffin | 312/135 |
| 5,551,772 | A | * | 9/1996 | Keffer | 312/114 |
| 5,758,779 | A | * | 6/1998 | Atkins | 211/32 |
| D398,789 | S | | 9/1998 | Warshawsky | |
| 5,848,710 | A | * | 12/1998 | Pomper | 211/85.2 |
| 6,206,208 | B1 | | 3/2001 | Dennig | |

(Continued)

OTHER PUBLICATIONS

International Search Report dated Nov. 18, 2008.

*Primary Examiner*—Darnell M Jayne
*Assistant Examiner*—Patrick Hawn
(74) *Attorney, Agent, or Firm*—Husch Blackwell LLP

(57) ABSTRACT

A jewelry holder and display includes an upstanding elongated stem or post the lower end of which is secured to a circular base which, in turn, is rotatably supported on a larger diameter primary base such that the upstanding stem can readily rotate about its longitudinal axis. The stem supports radially located extending pegs and also supports at its upper end a generally cylindrical cup-shaped receptacle member having a plurality of radially located extending pegs selectively secured to its outer circumference for supporting jewelry items such as necklaces, bracelets, watches and the like. The receptacle member has an internal chamber to receive small items of jewelry, such as rings and cuff links. A cover is provided to releasably cover an upper opening in the receptacle chamber which may be lined with a soft felt and can receive a ring support cushion.

17 Claims, 4 Drawing Sheets

U.S. PATENT DOCUMENTS

| | | | | |
|---|---|---|---|---|
| 6,241,105 | B1 | 6/2001 | Pomper | |
| 6,425,647 | B1 * | 7/2002 | Pothin | 312/249.2 |
| D468,131 | S | 1/2003 | Weichert | |
| D483,203 | S | 12/2003 | Dennig | |
| 7,077,301 | B2 | 7/2006 | Dudley | |
| 7,451,882 | B2 * | 11/2008 | McKay | 211/85.2 |
| 2005/0121583 | A1 | 6/2005 | Cavello et al. | |
| 2006/0289321 | A1 * | 12/2006 | Karfias | 206/413 |

* cited by examiner

JEWELRY HOLDER AND DISPLAY

CROSS REFERENCES

This application is a continuation-in-part application from, and claims the benefit of, applicant's design patent Ser. No. 29/284,399, now Pat. No. D 574,165, filed Sep. 7, 2007.

BACKGROUND OF THE INVENTION

Men and women have historically depended upon a jewelry box as a place to store jewelry when not being worn. Typically, jewelry boxes are relatively large and are utilized to hold a multiplicity of items in a more-or-less organized manner. Such jewelry boxes exhibit the drawback that small jewelry items may become hidden in the clutter of items in a jewelry box, particularly a jewelry box having a relatively large storage capacity. Even if like jewelry items are stored in a common location within the jewelry box, paired items, such as earrings and cuff links and the like, can become separated and difficult to locate and match up. Among the most problematic of all jewelry items in regard to safe storage, however, is the common necklace. The simple elegance and beauty of the necklace effectively conceals its delicate nature. The long stranded architecture of many necklaces results in seemingly hopeless entanglement whenever two or more are placed together in a common location in a jewelry box. The end result of attempts at separation is often a broken strand with an associated substantial bead spill. Adding to the frustration of such events is the fact that most people cope with these complexities and difficulties when their only real need is to have one convenient change of jewelry per day. Thus, a need exists for a simple, elegant and effective solution to this problem. More particularly, a need exists for a jewelry holder that can hold and display jewelry items such as rings, wrist watches, bracelets, necklaces, earrings, tie clips, cuff links, etc. as frequently worn by women and men in their place of employment, but which is also capable of conveniently holding jewelry of generally greater quality such as jewelry items worn during leisure and special social occasions. The present invention addresses this need.

Accordingly, the present invention provides a jewelry holder and display that enables a busy person to quickly and easily locate and select jewelry pieces for different occasions as the case may be, such as for the work environment or social occasions. For example, after a day at work, the jewelry holder of the present invention enables a person to quickly and easily select jewelry that is more appropriate to an evening of leisure. Upon returning from a social event, the jewelry holder allows the person to readily place the jewelry worn during the social occasion at selected locations on and/or within the jewelry holder separate and apart from jewelry to be worn to the work place. The next day, the cycle starts anew. In this manner, a person's jewelry is rarely forgotten, misplaced or damaged. As well, the jewelry holder of the present invention enables the jewelry to be located and displayed in plain sight, thereby adding to the beauty and elegance of the home décor. The extra time needed to change-out items of jewelry to effect variety can be put off until more time is available for such considerations, thus serving to uncomplicate a person's life.

In carrying out the present invention, a jewelry holder and display is provided that includes an upstanding elongated stem or post the lower end of which is secured to a circular base which in turn is rotatably supported on a larger diameter primary base such that the upstanding stem or post can readily rotate about its longitudinal axis. The stem or post supports at its upper end a generally cylindrical cup-shaped holder member having a plurality of generally radially extending pegs or holder arms selectively secured to its outer circumference for supporting jewelry items such as necklaces, bracelets, watches and the like. The cup-shaped holder member has an internal chamber or recess to receive and hold small items of jewelry, such as rings, cuff links and the like through an open upper end. A cover is provided to releasably cover the upper opening in the cup member. The internal chamber in the holder member may be lined with a soft felt fabric and can receive an optional ring support cushion.

Further objects, features and advantages of the jewelry holder and display in accordance with the invention will become apparent from the following detailed description when taken in conjunction with the accompanying drawings wherein like reference numerals designate like elements throughout the several views.

DETAILED DESCRIPTION OF THE INVENTION

Figure 1:
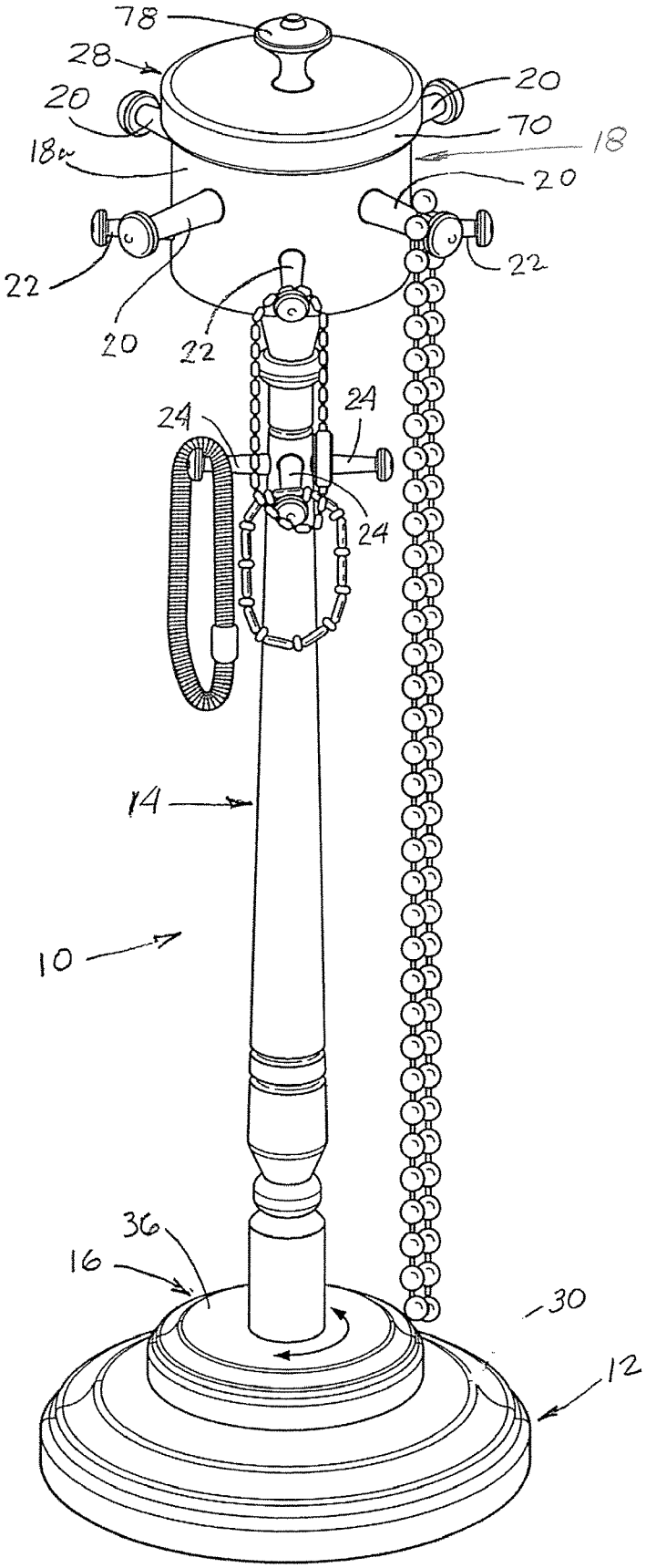
FIG. 1 is a perspective view of a jewelry holder and display device in accordance with the present invention.

Turning now to the drawings, and in particular to FIG. 1, a jewelry holder and display device constructed in accordance with the present invention is indicated generally at 10. Briefly, the jewelry holder and display 10 includes a base member 12, which may be termed a primary base member, on which is supported an elongated upstanding stem or shaft 14 for rotation about its longitudinal axis relative to the base member 12. To this end, the elongated stem 14 has its lower end affixed to a secondary base member 16 which, in turn, is attached to the primary base member 12 through means for enabling the secondary base member and associated stem to rotate about the longitudinal axis of the stem, as will be described.

A cup-shaped receptacle or holder, indicated generally at 18, is mounted on the upper end of the upstanding stem or shaft 14 so as to rotate with the stem. The cup-shaped receptacle 18 has a cylindrical outer peripheral surface 18*a* on which is mounted a plurality of selectively positioned jewelry support pegs or rods, indicated at 20 and 22, on which jewelry items can be hung. A further plurality of jewelry support pegs or rods 24 are selectively affixed in generally radial relation to the stem or shaft 14 so as to lie in a plane transverse to the longitudinal axis of the stem but spaced below the receptacle 18. The receptacle 18 has an internal chamber or cavity 26 (FIG. 2) for receiving and holding relatively smaller jewelry items such as rings and cuff links and the like. A cover 28 is sized to releasably fit loosely over the upper open end of the internal chamber 26 so as to close the chamber.

Figure 6:
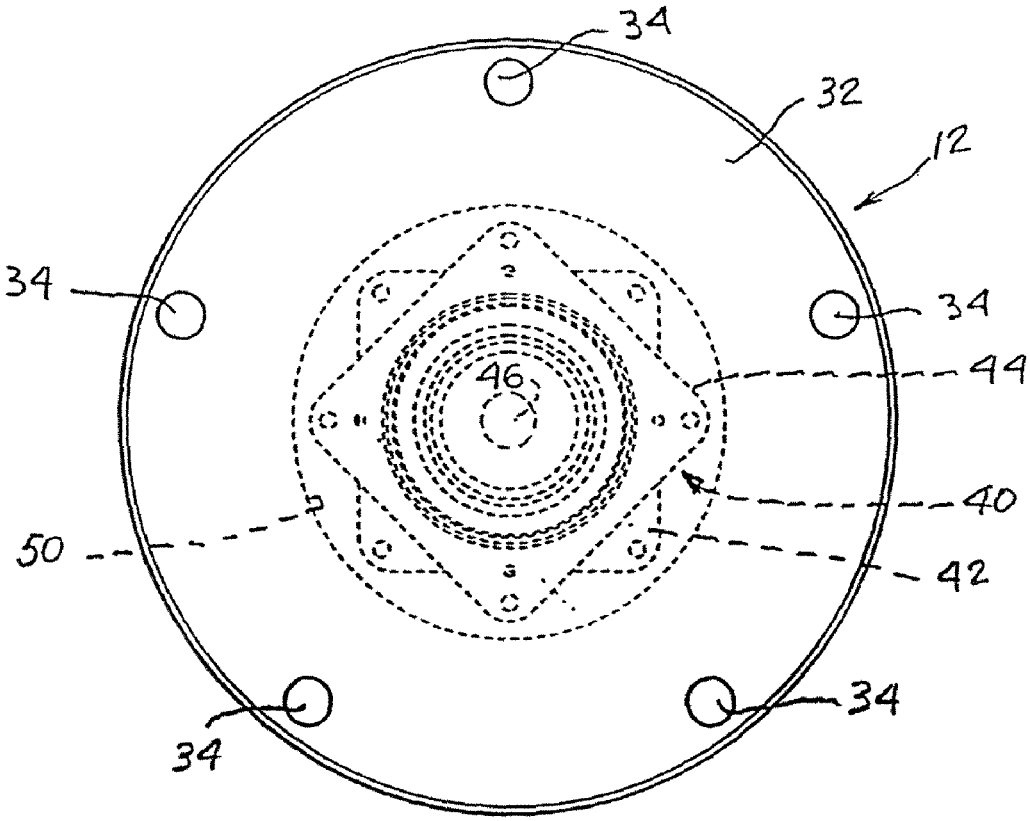
FIG. 6 is a bottom view of the primary base member showing mounting pads thereon and showing the rotational support means in hidden lines.

Turning now to a more detailed description of the jewelry and display device 10, the primary base member 12 is preferably made of a suitable material such as wood or a suitable synthetic material and has a circular plan configuration with an upwardly facing surface 30 formed with an aesthetically appealing contoured surface. Referring to FIG. 6, the primary base member 12 has a lower planar surface 32 on which are mounted a plurality of elastic pads 34, such as five in number, so that the pads lie on a common circle concentric with the geometrical center of the base and are equidistantly angularly spaced about the base center. In this manner, the base may be readily supported on a flat surface with the pads 34 preventing marring of a finished surface on which the jewelry holder and display may be supported.

Figure 5:
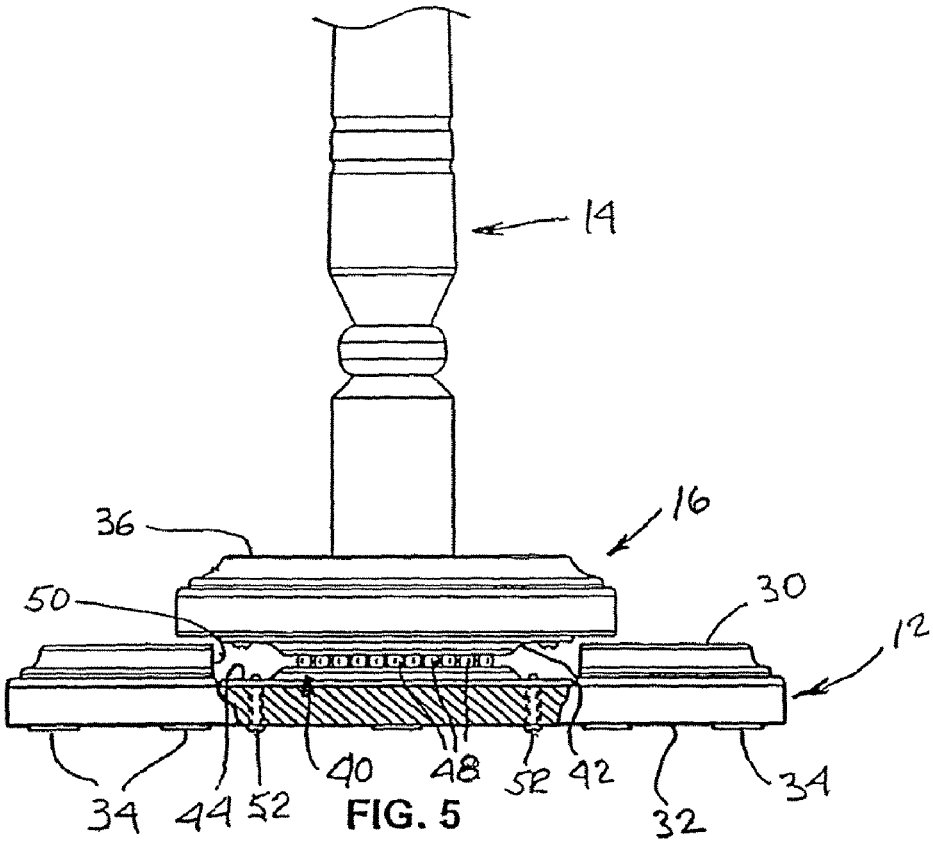
FIG. 5 is a fragmentary elevational view of the lower portion of the upstanding stem or shaft and the primary and secondary base members, portions being broken away to illustrate the rotational support means interposed between the base members.

Referring to FIGS. 5 and 6, taken in conjunction with FIG. 1, the secondary base member 16 is also preferably circular in plan configuration and has a contoured upper surface 36 that may be similar to the contoured upper surface 30 of the base member 12. The lower end of the upstanding stem 14 is centrally secured to the upper surface of the secondary base member 16 through suitable attachment means such as by screws, a dowel or a high strength glue or other suitable adhesive. The secondary base member 16 is mounted on the primary base member 12 by bearing means, indirected generally at 40, so that the secondary base member is concentric with the primary base member and spaced above the upper surface 30 of the primary base to facilitate rotation of the secondary base and associated stem 14 relative to the primary base. In the illustrated embodiment, the bearing means comprises a lazy Susan type bearing assembly interposed between the primary and secondary base members 12 and 16. As illustrated in FIGS. 5 and 6, the lazy Susan bearing assembly is of known design and has a pair of axially aligned and spaced substantially identical rectangular plates 42 and 44. The plates 42, 44 are interconnected for relative rotation about a center axis, such as indicated at 46, and capture an annular race of spherical bearings 48 therebetween to facilitate relative rotation of the plates.

As illustrated in FIG. 5, the upper plate 42 of the lazy Susan 40 is secured to the bottom surface of the base member 16 by suitable screws. The lower plate 44 of the lazy Susan is mounted within a recess 50 in the primary base member 12 by screws 52 that engage suitable taped bores in the lower plate 44. The depth of the recess 50 is such that the bottom of the secondary base member 16 is spaced above the top of the primary base member 12 sufficiently to provide clearance for free rotation of the secondary base and stem 14 relative to the primary base member. It will be understood that the lazy Susan-type bearing means provides a sturdy and reliable means for enabling free rotation of the stem 14 and receptacle or upper chamber 18 but that other means for facilitating free rotation between the primary and secondary base member 12 and 16, and thereby rotation of the stem 14 and receptacle 18, could also be employed.

Again, referring to FIGS. 1 and 2, in the illustrated embodiment, four of the upper pegs or rods 20 are mounted on the receptacle 18 so as to lie in a common plane substantially transverse to the longitudinal axis of the stem 14. The pegs preferably have enlarged outer ends and are angularly spaced 90 degrees apart about the receptacle. Pegs 20 preferably have axial lengths so that their outer ends overlie, but do not extend beyond, the outer perimeter of the primary base member 12. Four of the pegs or rods 22 are also mounted on the receptacle 18 so as to lie in a plane transverse to the longitudinal axis of the stem and spaced below the plane of pegs 20. The pegs 22 have shorter axial length than the pegs 20 and are angularly spaced 90 degrees apart but positioned so that each peg 22 lies in a vertical plane that forms an included 45 degree angle relative to vertical planes containing the axes of the two next adjacent upper pegs 20. Similarly, four pegs 24 are mounted on the stem 14 so as to lie in a plane transverse to the stem and spaced below the receptacle 18. The pegs 24 are positioned to lie below the pegs 22 and may be the same or slightly shorter in effective length than the pegs 22.

Figure 4:
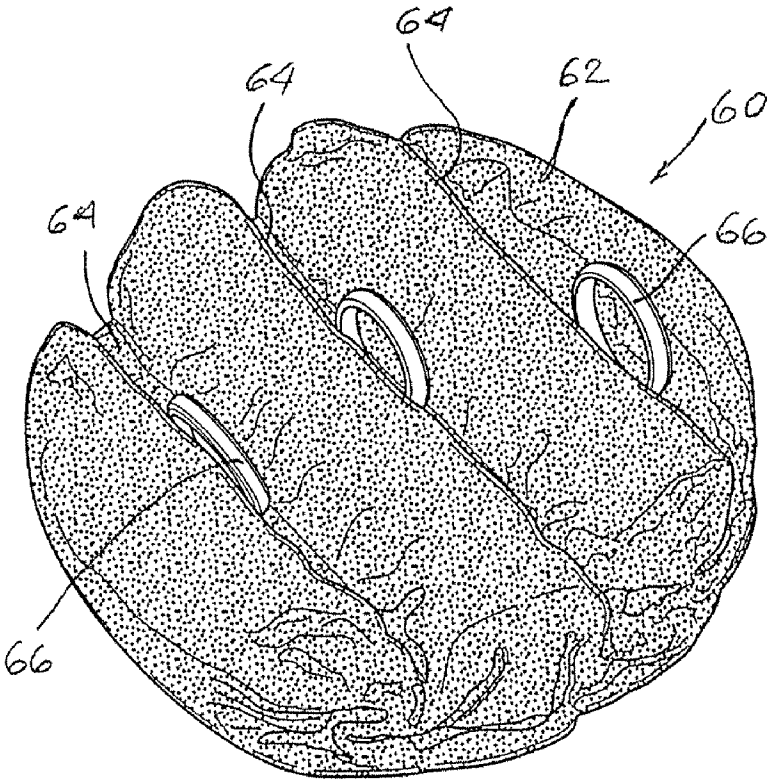
FIG. 4 is a perspective view of a ring holder pad or cushion adapted to be inserted into the upper cup holder portion as illustrated in FIG. 2.

Referring again to FIG. 2 taken in conjunction with FIG. 4, the internal chamber or cavity 26 in the cup-shaped receptacle 18 is cylindrical in shape defined by a bottom surface transverse to the longitudinal axis of the chamber, and an annular wall surface the upper edge of which establishes an upper opening into the chamber. A soft felt liner material 58 is preferably secured to both the internal bottom and peripheral wall surfaces of the chamber to accommodate jewelry items without marring them. Optionally, a jewelry holder cushion, such as indicated at 60 in FIG. 4, is sized to be inserted into the chamber 26. The cushion 60 has an annular outer periphery and may be formed with a plurality of compliant foam inserts covered by a soft felt material 62 so as to establish a plurality of grooves 64 to receive jewelry items such as rings 66 or cuff links or the like.

Figure 2:
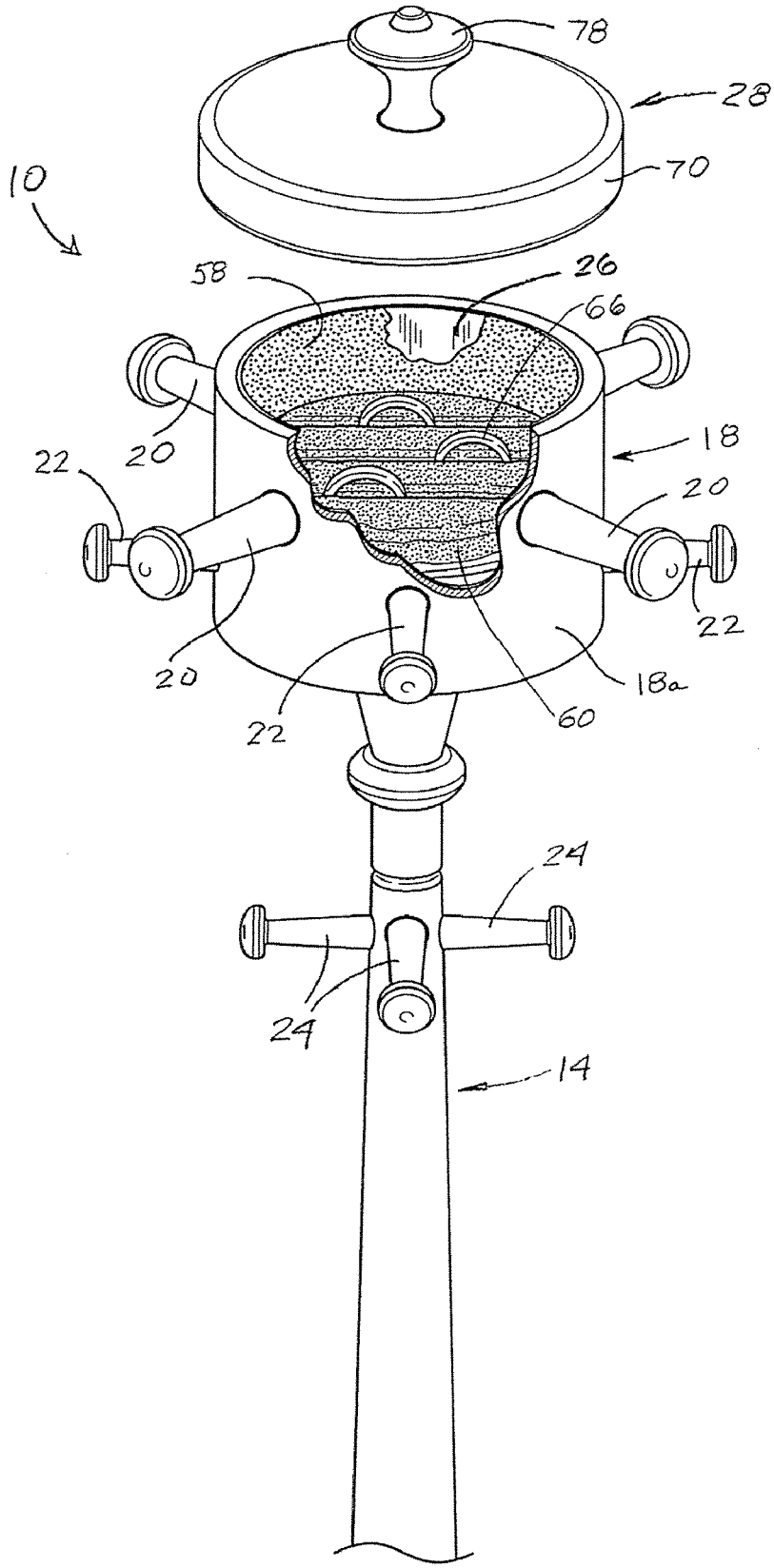
FIG. 2 is a fragmentary perspective view of the upper portion of the jewelry holder and display of FIG. 1 with the upper cover being raised and portions being broken away for clarity.
Figure 3:
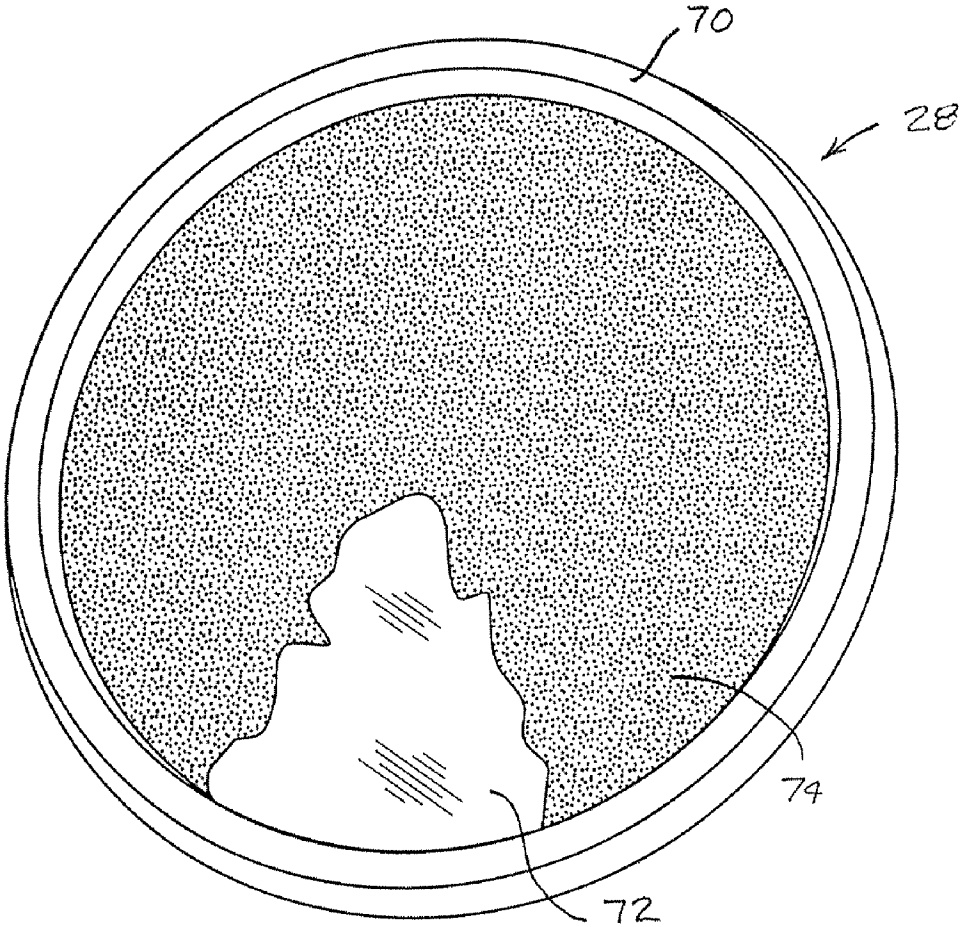
FIG. 3 is a bottom view of the upper cover shown in FIG. 2.

As shown in FIGS. 2 and 3, the cover 28 has an annular rim 70 that establishes an inner circular recessed area 72 having a diameter such that the cover can fit loosely on top of the receptacle 18 with the rim 70 extending below the upper annular edge of the receptacle. A circular soft felt liner 74 similar to the felt liner 58 is preferably secured to the inner circular recessed area 72 of the cover 28. Alternatively, a circular mirror could be secured within the cover recessed area 72 to create a hand-holdable mirror to assist in placement of jewelry items on the user. The mirror would preferably be of a lesser diameter than the diameter of the upper interior opening in the cup-shaped receptacle 18 to prevent the two from striking each other. A knob 78 is secured centrally to the outer surface of the cover 28 to facilitate hand gripping of the cover for placement of the cover on the receptacle 18 and removal therefrom. The knob 78 is sized and configured to allow a jewelry item, such as a bracelet or wrist watch, to be placed over the knob and temporarily retained on the cover, such as overnight.

Having thus described a presently preferred embodiment of the jewelry holder and display device in accordance with the present invention, it will be appreciated that the selective positioning and radial length sizing of the pegs 20, 22 and 24 enable jewelry items such as necklaces, bracelets, watches and similar items to be readily supported on and removed from the pegs without interfering with jewelry items already hung on the jewelry holder. The various components of the jewelry holder and display, except for the metallic lazy Susan and associated screws, can be made of wood and finished with a stain and varnish finish making the jewelry holder an attractive display for one's jewelry. The various components including the lazy Susan bearing can be made of alternative materials if desired. While the jewelry holder and display 10 may be made of various dimensional sizes, an overall height of approximately 24 inches, a cup-shaped receptacle of approximately 2.5 inches in height and approximately 4 inches in diameter, and a primary base diameter of approximately 8.5 inches provide appealing and utilitarian features that enhance the invention.

While a preferred embodiment of the invention has been illustrated and described, it will be understood that changes and modifications may be made therein without departing from the invention in its broader aspects. Various features of the invention are defined in the following claims

What is claimed is:

1. A jewelry holder and display device comprising a base member, an elongated thin, upstanding stem defining a longitudinal axis and supported on said base member for rotation about said longitudinal axis, a cup-shaped receptacle supported on an upper end of said stem, said receptacle defining an internal chamber having an access opening adapted to receive jewelry items, a cover member adapted for cooperation with said receptacle to releasably cover said access opening said cover being fixable to the receptacle and comprising a handle affixed coaxially with the stem such that when the cover is fixed to the receptacle the handle can be used to rotate the stem relative to the base member, a first plurality of jewelry support pegs mounted on an external peripheral surface of said receptacle so as to extend generally radially outwardly of said peripheral surface, said first plurality of pegs are disposed in alternating upper and lower vertically spaced planes substantially transverse to the longitudinal axis of said stem, said first plurality of pegs having a single taper along their length outwardly from the peripheral surface of said receptacle and comprising a stop at the distal end of the peg, said first plurality of support pegs being selectively offset relative to each other for enabling jewelry to be hung thereon, the single taper on said pegs biasing jewelry hung thereon away from the peripheral surfaces of the receptacle towards the distal end of the peg, and a second plurality of jewelry support pegs mounted on said elongated thin, upstanding stem.

2. A jewelry holder and display as defined in claim 1 wherein said support pegs have axial lengths relative to the longitudinal axis of the stem so as not to extend beyond the outer periphery of the base member.

3. A jewelry holder and display as defined in claim 1 including a plurality of support pads mounted on a planar lower surface of said base member, said support pads lying on a circle concentric with a geometric center of said planar lower surface and being equally circumferentially spaced about said geometric center.

4. A jewelry holder and display as defined in claim 3 wherein said planar lower surface is circular and said geometric center is the center of said circular surface.

5. A jewelry holder and display as defined in claim 1 wherein the first plurality of jewelry support pegs disposed in said upper substantially transverse plane are radially longer than the jewelry support pegs disposed in the lower substantially transverse plane so that jewelry items can be readily hung on the upper radial support pegs without interfering with the jewelry hung on the lower radial support pegs.

6. A jewelry holder and display as defined in claim 1 wherein said second plurality of jewelry support pegs are mounted on said stem so as to extend generally axially outwardly therefrom, said additional support pegs being sized so as to extend outwardly from said stem a distance less than outer ends of said support pegs mounted on said receptacle.

7. A jewelry holder and display as defined in claim 1 wherein said internal chamber in said receptacle is defined by a base surface and a peripheral wall surface, and including a soft fabric liner secured to said base and peripheral wall surfaces.

8. A jewelry holder and display as defined in claim 7 including jewelry support cushion means adapted to be inserted within said internal chamber and operative to receive and support small size jewelry in generally releasable fixed relation thereon.

9. A jewelry holder and display as defined in claim 1 including bearing means interposed between said base member and said stem for enabling rotation of said stem and cup-shaped receptacle relative to said base member.

10. A jewelry holder and display as defined in claim 9 wherein a lower end of said stem is affixed to a lower plate member, said bearing means including a bearing plate assembly connecting said lower plate member to said base member in a manner to enable rotation of said stem about its longitudinal axis relative to said base member.

11. A jewelry holder and display as defined in claim 10 wherein said bearing plate assembly comprises a lazy Susan type turntable having a pair of axially opposed plates with bearings interposed therebetween, said opposed plates being secured, respectively, to said base member and said lower plate member.

12. A jewelry holder and display device comprising a primary base member adapted to be supported on a substantially flat support surface, an elongated upstanding stem defining a rectilinear longitudinal axis and having a lower end affixed in normal relation to a secondary base member, bearing means interposed between said primary and secondary base members for enabling rotation of said stem about its longitudinal axis, a cup-shaped receptacle supported on an upper end of said stem, said receptacle defining a generally cylindrical internal chamber having an upper access opening adapted to receive jewelry items within said chamber, a cover member adapted for cooperation with said receptacle to releasably cover said access opening said cover being fixable to the receptacle and comprising a handle affixed coaxially with the stem such that when the cover is fixed to the receptacle the handle can be used to rotate the stem relative to the base member, a first plurality of jewelry support pegs mounted on an external peripheral surface of said receptacle so as to extend generally radially outwardly of said peripheral surface, said first plurality of support pegs being selectively supported in vertically spaced planes substantially transverse to the longitudinal axis of said stem so as to be offset relative to each other for enabling jewelry to be hung thereon, said first plurality of support pegs having a single taper along their length outwardly from the peripheral surface of said receptacle and comprising a stop at the distal end of the peg, and a second plurality of jewelry support pegs mounted on said thin, elongated upstanding stem.

13. A jewelry holder and display as defined in claim 12 wherein said first and second plurality of support pegs have axial lengths relative to the longitudinal axis of the stem so as not to extend outwardly beyond the outer periphery of the primary base member.

14. A jewelry holder and display as defined in claim 12 including a plurality of support pads mounted on a planar lower surface of said base member, said support pads lying on a circle concentric with a geometric center of said planar lower surface and being equally circumferentially spaced about said geometric center.

15. A jewelry holder and display as defined in claim 12 wherein said first plurality of jewelry support pegs are disposed in alternating upper and lower vertically spaced planes substantially transverse to the longitudinal axis of said stem.

16. A jewelry holder and display as defined in claim 15 wherein the first plurality of jewelry support pegs disposed in said upper substantially transverse plane are axially longer than the jewelry support pegs disposed in the lower substantially transverse plane so that jewelry items can be readily hung on the upper radial support pegs without interfering with the jewelry hung on the lower radial support pegs.

17. A jewelry holder and display as defined in claim 12 wherein said bearing means comprises a lazy Susan type turntable having a pair of axially opposed plates with bearings interposed therebetween, said opposed plates being secured, respectively, to said primary and secondary base members.

* * * * *